United States Patent [19]

Watanabe et al.

[11] Patent Number: 4,971,636

[45] Date of Patent: Nov. 20, 1990

[54] METHOD OF PRODUCING HIGHLY CORROSION-RESISTANT SURFACE-TREATED STEEL PLATES

[75] Inventors: Tsutomu Watanabe; Masaaki Yamashita; Takahiro Kuboto, all of Tokyo, Japan

[73] Assignee: NKK Corporation, Tokyo, Japan

[21] Appl. No.: 369,465

[22] Filed: Jun. 21, 1989

[30] Foreign Application Priority Data

Jun. 30, 1988 [JP] Japan ..... 63-163718

[51] Int. Cl.[5] ..... C23C 22/24; C23C 22/82

[52] U.S. Cl. ..... 148/265; 148/258; 148/267; 148/268

[58] Field of Search ..... 148/258, 265, 268, 267, 148/255, 259

[56] References Cited

U.S. PATENT DOCUMENTS

| | | | |
|---|---|---|---|
| 2,851,385 | 9/1958 | Spruance | 148/268 |
| 4,098,620 | 7/1978 | Sato | 148/265 |
| 4,146,410 | 3/1979 | Reinhold | 148/268 |
| 4,157,924 | 6/1979 | Elms | 148/265 |
| 4,647,316 | 3/1987 | Prescott | 148/258 |

*Primary Examiner*—Jay H. Woo
*Assistant Examiner*—Jeremiah F. Durkin, II.
*Attorney, Agent, or Firm*—Henry C. Nields

[57] ABSTRACT

A method of producing highly corrosion-resistant surface-treated steel plates where Cr elusion is small in spite of drying at low temperatures and corrosion resistance is excellent. In a process for producing surface treated steels where Zn type plated steels are treated through (i) chromate treatment, (ii) coating a resin composition and (iii) baking treatment, zirconium fluoride ion and Zn ion of appropriate amounts are added into the chromate bath, and $Cr^{6+}/Cr^{3+}$ratio in the bath is controlled to be low. Further the resin composition to be coated after the chromate treatment is rendered a solvent type resin composition obtained by adding silica and/or sparingly water soluble Cr compound to basic epoxy resin.

36 Claims, No Drawings

METHOD OF PRODUCING HIGHLY CORROSION-RESISTANT SURFACE-TREATED STEEL PLATES

TECHNICAL FIELD

The present invention relates to a method of producing highly corrosion resistant surface-treated steel plates suited to outer shells of automobiles, home electrical appliances and others.

BACKGROUND OF THE INVENTION

Chromate treated steel plates are widely used as steel plates modified for rust prevention of zinc type plated steel plates. In general, chromate treatments are roughly divided into three types of electrolytic, reaction and coating types.

The electrolytic type produces films of mainly $Cr^{3+}$. This film has a high degree of accomplishment, and is sparingly water soluble, and further has an excellent anchoring effect as an undercoat, but this is inferior in corrosion resistance, because $Cr^{6+}$is lacked.

Since the reaction type reduces and precipitates a chromate film on a plated surface by the chemical reaction with $Cr^{6+}$ion and dissolution of a basic metal due to acid, only films of mainly $Cr^{6+}$are obtained. The amount of adhering Cr can be easily increased, but a corrosion resistance could not be improved so much.

In the coating type, a treating solution where inorganic type additives such as silica are added to a basic bath of mainly chromic anhydride, is coated on the steel surface and dried. Since this film contains much $Cr^{6+}$, it has the most excellent corrosion resistance and exhibits a high corrosion resistance in response to the adhering amount of Cr. But as $Cr^{6+}$is water soluble, Cr eludes during use of a water soluble paint or a degreasing process as a pre-treating process for painting. Thus, an available adhesion amount of Cr is limited.

As a method of improving the Cr elusion of the coating type, there have been proposed methods where the chromate treating solution is coated, dried, and water-washed away (including a hot water-washing), thereby to in advance elude the water soluble $Cr^{6+}$(Japanese Patent Application Laid Open Specifications No. 202083/87 and No. 202084/87).

Further, known improvements of the Cr elusion dry the chromate solution of the normal coating type at high temperature as shown in the Japanese Patent Publication No. 38891/70 or by lengthening a drying time (CAMP-ISIJ Vol. (1988) 680).

However, since the water-washing of the dried chromate treating solution loses $Cr^{6+}$having a self repairing function, the corrosion resistance is remarkably deteriorated.

For the water-washing method, it will be considered to lower the ratio of $Cr^{6+}$in the chromate solution.

For lowering the ratio of $Cr^{6+}$in the chromate solution, organic reducing agents such as saccharoid or alcohol or inorganic reducing agents are generally employed. If the weight ratio of $Cr^{6+}/Cr^{3+}$is not more than 50/50, the chromate solution is gelatinized in a short period of time. The lower limit of $Cr^{6+}/Cr^{3+}$ratio for stable use of the chromate solution, has conventionally been around 60/40. But in spite of using the chromate solution reduced to such an extent, the accomplishing degree of a chromate film could not be heightened, and the improvement of the Cr elusion could not be expected.

When the film is dried at the high temperature, the Cr elusion is more or less improved, but the water soluble $Cr^{6+}$is still lowered, and at the same time the chromate film is cracked and the corrosion resistance is decreased. Further for improving the Cr elusion by drying at the high temperature, a temperature exceeding 200° C. is required and problems occur in view of product ion costs.

The present invention has been realized in view of the foregoing problems, and is to provide a method of producing highly corrosion-resistant surface-treated steel plates, where the Cr elusion is little in spite of drying at the low temperature, the chromate film is satisfied with the corrosion resistance, and the surface treated steel plate itself has an excellent corrosion resistance.

DISCLOSURE OF THE INVENTION

The inventors made studies on the chromate films and resin composition films at standpoints of the Cr elusion and the corrosion resistance, and obtained under mentioned results.

(i) When the ratio of $Cr^{6+}/Cr^{3+}$in the chromate solution is lowered, a phosphate ion is effective to prevention of $Cr^{3+}$from gelation.

If zirconium fluoride ion exists in the chromate solution, it forms a complexing compound with $Cr^{6+}$and checks the elusion of $Cr^{6+}$. Zn ion in the bath improves the Cr elusion by the chromate ion as zinc chromate.

Therefore, if these elements are controlled appropriately, the Cr elusion may be effectively controlled.

(ii) As resin compositions, epoxy resin is desirable in view of the corrosion resistance, and among the epoxy resins, a basic epoxy resin has an excellent durability and a satisfactory adhesion with respect to effect of interfacial alkali formed at the time of an electrodeposition.

(iii) With respect to the corrosion resistance and the paint adhesion under wet conditions, the solvent type resins are superior to water soluble or water dispersion type resins. The hydrophilic resins cannot avoid the elusion of $Cr^{6+}$from the chromate film during the paint coating process, and the hydrophilic resins are gelatinized by the eluding $Cr^{6+}$ion to make the working slow down. Therefore, also in this sense, the solvent type resins are preferable.

(iv) Corrosive products are made stable by adding the silica to the resin, and the corrosion resistance is further improved by passivating effect of a sparingly water soluble Cr compound.

The present invention has been built on these above stated points.

A first method thereof comprises carrying out a chromate treatment of coating on the surface of a zinc or zinc alloy plated steel plate a chromate solution containing chromic acid: 5 to 100 g/l
phosphate ion: 0.5 to 20 g/l
zirconium fluoride ion: 0.2 to 4 g/l, and
Zr ion: 0.2 to 7 g/l, which is controlled in weight ratio of $Cr^{6+}/Cr^{3+}=3/4$ to 3/2 chromic acid/zirconium fluoride ion=10/1 to 100/1;

coating on an upper part of a chromate film, without water-washing, a solvent type resin composition comprising a base resin obtained by adding at least one basic nitrogen atom and at least two primary hydroxyl groups to terminals of an epoxy resin which is mixed with silica in weight ratio of base resin/silica=80/20 to 50/50; and subsequently carrying out a baking treatment.

A second method thereof comprises carrying out coating on an upper part of the above mentioned chromate film a solvent type resin composition comprising a base resin obtained by adding at least one basic nitrogen atom and at least two primary hydroxyl groups to terminals of an epoxy resin which is mixed with sparingly water soluble Cr compound in weight ratio of base resin/ sparingly water soluble Cr compound=80/20 to 50/50; and subsequently carrying out a baking treatment.

A third method thereof comprises carrying out coating on an upper part of the above mentioned chromate film a solvent type resin composition comprising a base resin obtained by adding at least one basic nitrogen atom and at least two primary hydroxyl groups to terminals of an epoxy resin which is mixed with silica and sparingly water soluble Cr compound in weight ratio of base resin/(silica+sparingly water soluble Cr compound) =80/20 to 50/50;

silica/sparingly water soluble Cr compound =37/3 to 20/20; and subsequently carrying out a baking treatment.

DETAILED DESCRIPTION OF THE INVENTION

The present invention will be explained hereinafter.

As plated steel sheets to be used in the invention, there may be listed Zn plated steels, Zn-Fe alloy plated steels, Zn-Ni alloy plated steels, Zn-Mn alloy plated steels, Zn-Al alloy plated steels, Zn-Co-Cr alloy plated steels, and those obtained by adding one or more than two selected from Ni, Fe, Mn, Mo, Co, Al and Cr to the above listed plating elements. There may be also composite plated steels having more than two layers of homogeneous or heterogeneous sorts. As plating processes, any of available process may be adopted from an electrolytic deposition process, a melt deposition process and a gas phase deposition process. Among them, the electrolytic process is useful because it does not select qualities of cold rolled steel plates to be substrates.

The above mentioned zinc group plated steels are performed with the chromate treatment by coating, on the plated steels, the chromate solution containing chromic acid: 5 to 100 g/l phosphate ion: 0.5 to 20 g/l zirconium fluoride ion: 0.2 to 4 g/l Zr ion: 0.2 to 7 g/l which is controlled in weight ratio of $CR^{6+}/Cr^{3+}=3/4$ to 3/2 chromic acid/zirconium fluoride ion =10/1 to 100/1; and drying the coated solution.

Herein, if the concentration of the chromic acid is less than 5 g/l, an adhesion amount of the chromate film to be formed on the surface of the work is lacking, and the corrosion resistance is inferior. On the other hand, if it exceeds 100 g/l the adhesion amount is too much, and the weldability is inferior.

The phosphate ion is useful to prevent $Cr^{3+}$from gelatinization. If its concentration is less than 0.5 g/l it cannot prevent the gelation and the chromate bath is made unstable in the ratio of $Cr^{6+}/Cr^{3+}$of the invention, the chromate film precipitates. On the other hand, it exceeds 20 g/l, dissolution of zinc plating is accelerated in company with lowering of pH of the bath and the corrosion resistance is weakened.

The zirconium fluoride ion forms a complex compound with $CR^{6+}$and is effective to prevention of the elusion of $Cr^{6+}$. If its concentration is less than 0.2 g/l, such an effect could not be obtained, and the corrosion resistance is weakened. If the concentration exceeds 4 g/l, etchings are too much on the surface of the zinc plated work, and the concentration of Zn becomes high and accelerates the gelation of the solution.

Zn ion has an effect to improve the Cr elusion by changing the chromate ion into zinc chromate. If its concentration is less than 0.2 g/l, an improved effect of the Cr elusion cannot be expected. If the concentration is more than 7 g/l, the chromate solution is gelatinized unpreferably.

If the weight ratio of $Cr^{6+}/Cr^{3+}$is less than 3/4, the chromate solution is made unstable, and the repairing effect of $Cr^{6+}$is insufficient and the corrosion resistance is weakened. But if the weight ratio is more than 3/2, such a film is formed that the Cr elusion is much and the paint adhesion is deteriorated.

If the weight ratio of chromic acid/zirconium fluoride ion is less than 10/1 and since the forming reaction of the complex compound with $Cr^{6+}$by zirconium fluoride ion progresses extraordinarily, the self repairing effect of $Cr^{6+}$is hindered and the corrosion resistance is deteriorated. If it is more than 100/1, the improvement of the Cr elusion by zirconium fluoride ion is insufficient, and a desired corrosion resistance cannot be provided.

Chromic acid in the solution is obtained by adding chromic anhydride, and $Cr^{6+}/Cr^{3+}$is controlled by reducing $Cr^{6+}$to $Cr^{3+}$by means of reducing agents such as oxalic acid, tannic acid, starch, alcohol or hydrazine. Chromate ion is obtained by adding orthophosphoric acid or ammonium phosphate. Zirconium fluoride ion is preferably added in a form of $ZrF_6^{2-}$, and is obtained by adding $(NH_4)_2ZrF_6$, $H_2Zr_6$ and so on.

The adhesion amount of the chromate film is appropriate to be 10 to 200 mg/m$^2$ calculated as metallic chromium, preferably 30 to 150 mg/m$^2$. If the adhesion amount is more than 200 mg/m$^2$, the Cr elusion and the weldability are deteriorated, and the sufficient corrosion resistance could not be provided with less than 10 mg/m$^2$.

The coating of the chromate solution in the invention may depend upon any one of roll coater, immersion, spraying or the like.

After the above mentioned chromate treatment, the chromate film is, without water-washing (inclusive of a warm-washing), coated with the solvent type resin composition comprising resin obtained by adding at least one basic nitrogen atom and at least two primary hydroxyl groups to terminals of an epoxy resin which is mixed with silica and/or the sparingly water soluble Cr compound.

As the base resin to be employed to the resin composition, epoxy resin which is a condensation product obtained by condensing bisphenol A with epichlorohydrin, is excellent in the corrosion resistance, As epoxy resin, one or mixture of Epikotes 828, 1001, 1004, 1007, 1009 and 1010 by Shell Chemical may be used.

A basic epoxy resin film obtained by adding at least one basic nitrogen atom to terminals thereof does not deteriorate its resin structure with respect to alkali which occurs on the surface during a cation electrodeposition which is especially used for automobiles, and brings about a desirable adhesion. If the primary hydroxyl group of more than 2 mols is introduced into one molecule of epoxy, the resin structure may be made closer.

As means for introducing basic nitrogen atoms and primary hydroxyl groups, for example, there can be adopted a method in which an alkanolamine and/or an alkylalkanolamine are added to an oxirane group of the epoxy resin. As the amine, for example, there can be mentioned monoethanolamine, diethanolamine, dimethylaminoethanol, monopropanolamine, dipropanolamine and dibutanolamine. These amines can be used singly or in the form of mixtures of two or more of them.

If the primary hydroxyl group of more than 2 mols in average can be contained in one molecule of the epoxy resin, the epoxy resin may be partially modified with other compound. As the means for the partial modification of the epoxy resin, there are (1) esterification with monocarboxylic acid; (2) modification with an aliphatic or aromatic amine; and (3) modification with hydroxyacid. There is also a modification with dicarboxylic acid but this method is not suitable for the resin composition of the invention, because the control of molecular weight is difficult.

The base of epoxy resin is neutralized with a low-molecular weight acid for using as a water-dispersible or water-soluble composition. However, such a use does not allow to bring about tough films when the paint is burnt at a low temperature. As a result, the acid compound necessary to solubilization in water forms a salt in the film, and the water is readily absorbed in or below the film in a wet environment, so that the corrosion resistance and the paint adhesion are deteriorated. In addition, when these hydrophilic compounds are used, $Cr^{6+}$in the chromate film eludes into a liquid resin, and the liquid is easily gelatinized and an operation is lowered. From these points, the solvent type is used as the resin compositions.

As the organic solvent, there can be mixed hydrocarbon type, ketone type, ester type, ether type, low-molecular weight alcohol having up to 4 carbon atoms, or one or more than two of alcohols having a secondary or tertiary hydroxyl group. But the alcohol type solvents of high boiling points are not preferable, because the curing reaction of the resin film is hindered thereby.

As curing means for forming the film of the resin composition, there is preferably adopted a method in which urethanation reaction between the isocyanate and the hydroxyl group in the base resin is a main reaction. In order to stably store the resin composition before formation of the film, it is necessary to protect the isocyanate of the curing agent. As the protecting means, there may be adopted a method in which isocyanate compound is protected so that the protecting group is isolated by heating to regenerate the isocyanate group.

As the isocyanate compound, there can be used aliphatic isocyanates, alicyclic isocyanates (inclusive of heterocyclic isocyanates) or aromatic isocyanates having at least two isocyanate group in one molecule, and compounds obtained by partially reacting these isocyanate compounds with a polyhydric alcohol. For example, there can be mentioned: (1) m- or p-phenylene diisocyanate, 2,4- or 2,6-tolylene diisocyanate, or p-xylene diisocyanate, hexamethylene diisocyanate, dimer acid diisocyanate and isophorone diisocyanate; and (2) reaction products obtained by reacting at least one member selected from the compounds mentioned in (1) above with a polyhydric alcohol (for example, a dihydric alcohol such as ethylene glycol or propylene glycol, a trihydric alcohol such as glycerol or trimethylolpropane, a tetrahydric alcohol such as pentaerythritol or a hexahydric alcohol such as sorbitol or dipentaerythritol), which have at least 2 isocyanate groups left in one molecule.

As the protecting agent (blocking agent), there can be mentioned, for example, (1) aliphatic alcohols such as methanol, ethanol, propanol, butanol or octyl alcohol;
(2) monoethers of ethylene glycol and/or diethylene glycol such as methyl, ethyl, propyl (n- and iso) and butyl (n-, iso- and sec-) monoethers;
(3) aromatic alcohols such as phenol and cresol; and
(4) oximes such as acetoxime and methylethyl ketone oxime.

By reacting the above mentioned isocyanate compound with at least one compound selected from the foregoing compounds, the isocyanate compound protected stably at least under the normal temperature conditions can be obtained.

It is preferred that the isocyanate compound as the curing agent be incorporated in an amount of 5 to 80 parts, especially 10 to 50 parts, per 100 parts by the base resin (as the solid). Since the isocyanate compound has a water-absorbing property, and if the isocyanate compound is incorporated in an amount exceeding 80 parts, the adhesion is degraded. Furthermore, if the surface-treated steel plate for a car body is subjected to the electrodeposition coating or spray coating operation, a non-reacted isocyanate compound migrates into the coating to inhibit curing of the coating and degrade the adhesion. In view of the foregoing, it is preferred that the isocyanate compound be incorporated in an amount of up to 80 parts by weight per 100 parts by weight of the base resin.

An alkyl-etherified amino resin obtained by reacting parts or all of a methylol compound which is formed by reacting at least one member selected from melamine, urea and benzoguanamine with formaldehyde, with a monohydric alcohol having 1 to 5 carbon atoms, may be used as the crosslinking agent in combination with the isocyanate compound.

The resin can be sufficiently crosslinked by the above mentioned crosslinking agent. In order to further increase the low-temperature crosslinking property, it is preferred that a known curing promoting catalyst be used in combination with the curing agent. As the curing promoting catalyst, there can be mentioned, for example, N-ethylmorpholine, dibutyl tin laurate, cobalt naphthenate, stannous chloride, zinc naphthenate and bismus nitrate. Moreover, a known resin such as an acrylic resin, and alkyd resin or a polyester may be incorporated into the resin composition for improving certain physical properties such as the adhesiveness.

In the invention, the silica and/or the sparingly water soluble Cr compound are contained in the resin composition for improving the corrosion resistance.

As mentioned above, it is presumed that when $Zn^{2+}$, etc. elude from the undercoat deposition layer, silica reacts with $Zn^{2+}$to form a stable corrosive product over the entire surface of a sample, which produces an anti-corrosive effect. On the other hand, the sparingly water soluble Cr compound eludes a slight amount of $Cr^{6+}$, which is then passivated to produce an anti-corrosive effect. This effect becomes particularly remarkable in a corrosive environment such as SST where a dissolution takes place continuously.

If the weight ratio of base resin/silica exceeds 80/20, the improvement of the corrosion resistant property obtained by mixing silica could not be expected, and if it is less than 50/50 the bindering effect of the base resin is rendered insufficient and a workability of the film is deteriorated.

As the silica that is used in the invention, there can be mentioned colloidal silica, hydrophilic silica called as "fumed silica" and hydrophobic silica. Attainment of an effect of improving the corrosion resistance is expected even by use of hydrophilic silica, but as described hereinafter, hydrophobic silica improves the corrosion resistance more prominently. It is preferred that the particle size of silica be 1 to 500 mμ, especially 5 to 100 μm.

Colloidal silica or hydophilic silica known as fumed silica has the surface covered with a hydroxyl group (silanol group → Si—OH), and it shows hydrophilic properties. Since this silanol groups rich in the reactivity, it readily reacts with various organic compounds to render the surface of silica organic.

Hydrophobic silica is formed by substituting the silanol group on the surface of this hydrophilic silica partially or substantially completely with a methyl group or alkyl group to render the surface hydrophobic.

There are various methods for the production of hydrophobic silica. For example, there can be mentioned reactions using an organic solvent such as an alcohol, a ketone or an ester, a silane, a silazane or a polysiloxane. As the reaction method, there can be mentioned a method in which the reaction is carried out in an organic solvent under compression and a method in which heating is effected in the presence of a catalyst.

Silica has an excellent anti-corrosive effect, and hydrophobic silica is especially effective for improving the corrosion resistance. For example in Japanese Patent Application Laid-Open Specification No.224174/83 mentioned hereinbefore, it is taught that the hydrophilic colloidal silica is added to an organic resin. However, since hydrophilic silica is highly hydrophilic, the compatibility with a solvent is poor, and because of this high hydrophilic characteristic, permeation of the water is readily caused, resulting in reduction of the corrosion resistance, and it is presumed that initial rusting is readily caused in a wet environment.

Therefore, in the production of the steel plate of the invention, it is preferred that silica having the surface rendered hydrophobic (hydrophobic silica) be incorporated into the basic epoxy resin to increase the compatibility with the basic epoxy resin and obtain a high corrosion resistance.

As such hydrophobic silica, there can be mentioned the silica, the surface of which is rendered hydrophobic with the organic solvent or reacting silane compound, that is, hydrophobic ultra-fine particulates silica (for example, R974, R811, R812, R805, T805, R202, RY200 or RX200 supplied by Nippon Aerosil).

Hydrophobic silica as described above is stably dispersed in the basic epoxy resin.

If the weight ratio of base resin/sparingly water soluble Cr compound exceeds 80/20, the improvement of the corrosion resistant property obtained by mixing the sparingly water soluble Cr compound could not be expected, and if it is less than 50/50 the bindering effect of the base resin is rendered insufficient and a workability of the film is deteriorated.

As the sparingly water soluble Cr compound, use may be made of powders of barium chromate ($BaCrO_4$), strontium chromate ($SrCrO_4$), lead chromate ($PbCrO_4$), zinc chromate ($ZnCrO_4.4Zn(OH)_2$) calcium chromate ($CaCrO_4$), potassium chromate ($K_2O.4ZnO.4CrO_3.3H_2O$) and silver chromate ($AgCrO_4$) One or two or more of these compounds is or are dispersed in the base resin.

Other chromium compounds are inferior in the compatibility with the base resin, or are poor in the two-coat adhesion because soluble $Cr^{6+}$is contained in a large amount, though they exhibit a certain anti-corrosive effect. Therefore, other chromium compounds are not suitable for attaining the objects of the invention.

However, preference is given to $BaCrO_4$ and $SrCrO_4$ in view of the corrosion resistance of steel sheets designed to be subjected to severe workings (e.g., drawbead testing) or extremely sharp cutting (width: about 1 mm).

When the surface-treated steel sheets obtained according to the present invention are actually sued by the consumes, they may often be coated. When coating is carried out by automotive makers, pre-treatments such as degreasing, surface regulation and phosphate treatments may be carried out, as occasion arises. The surface-treated steel sheets obtained according to the invention releases Cr, although in slight amounts, at the pre-treatment steps for coating, since the chromate undercoat and the resin film contain soluble $Cr^{6+}$. When discharging waste water produced at such pretreatment steps in surroundings, automotive makers dispose measurements for waste water, since its Cr concentration is regulated by an environmental standard. Due to certain limitation imposed upon the ability of waste water disposal plants, however it is preferred that the amount of Cr elution is reduced.

Of the sparingly water soluble Cr compound incorporated into the substrate resin, $BaCrO_4$ releases Cr at the pre-treatment steps in an amount smaller than do other chromate compounds. In view of the Cr elusion, therefore, it is preferred to use $BaCrO_4$.

Incidentally, when contained as the rust preventive in the resin film, the sparingly water soluble Cr compound is expected to produce no appreciable corrosion-proof effect in accelerated corrosion tests wherein wet and dry conditions appear alternately as is the case with CCT simulating an actual corrosive environment. In such tests, to sue silica as the rust preventive is rather more effective. When accelerated tests are carried out with samples subjected to severe working or extremely sharp cutting, however, no sufficient repairing effect is produced on injured regions by incorporating only silica in the resin as the rust preventive.

According to the invention, the silica and the sparingly water soluible Cr compound different from each other in the corrosion-proof mechanism are contained in the resin in some specific proportions, thereby achieving improved corrosion resistance through their synergistic effects upon corrosion-proof.

For the complex mixture of silica, sparingly water soluble Cr compound, the mixture is specified in the weight ratio of Base resin/(silica+sparingly water soluble Cr compound) =80/20 to 50/50

Silica/sparingly water soluble Cr compound =37/3 to 20/20.

If the weight ratio of base resin/(silica+sparingly water soluble Cr compound) exceeds 80/20, the improvement of the corrosion resistant property obtained by mixing silica and the sparingly water soluble Cr compound could not be expected, and if it is less than 50/50 the bindering effect of the base resin is rendered insufficient and a workability of the film is deteriorated.

If the weight ratio of silica/sparingly water soluble Cr compound exceeds 37/3, the repairing effect of by $Cr^{6+}$by the sparingly water soluble Cr compound could not be expected, and the corrosion resistance is insufficient. If it is less than 20/20, the stabilization of the corrosive product is insufficient, and the corrosion resistance is deteriorated.

Thus, by the complex mixture of silica and the sparingly water soluble Cr compound in the limited amount, the excellent corrosion resistance can be obtained even under the severe corrosive environment.

In such a complex mixture, more than two of heterogeneous sorts may be incorporated, and a satisfied corrosion resistance may be provided under the above mentioned mixture condition.

As others than the above mentioned silica and the sparingly water soluble Cr compound, known additives (e.g., surface active agent, etc), rust-preventive pigments such as chromium type, non-chromium type rust preventive pigment, extender pigments, coloring pigments may be mixed.

In the invention, the above mentioned resin compositions are coated by means of a roll coater, an air knife or the like, and subsequently subjected to the baking treatment.

The baking treatment is carried out at the temperature of the steel sheet between 50 and 200° C., preferably 60 and 150° C., and a dried film is obtained by maintaining at the above temperatures for several seconds to several minutes. The baking is ordinarily performed by supplying a hot wind, but is not to limited thereto. In the present invention, desired films may be obtained by the baking at comparatively low temperatures.

Herein, if the baking temperature is less than 50° C., the amount of the Cr elusion is much to cause problems, and more than 60° C. is preferable in this regard.

On the other hand, if it is more than 20° C., the economics is damaged and the corrosion resistance is deteriorated. It is presumed that if the baking temperature exceeds 200° C. by evaporation of water contained in the chromate film and abrupt advance of dehydration condensation of hydroxyl groups $$(-\overset{|}{Cr}-OH),$$

destruction of the chromate film is advanced by formation of cracks in the chromate film and by reduction of $Cr^{6+}$, the passivating action is weakened. If the baking temperature is preferably not more than 150° C., an operation will be advantageous in the corrosion resistance and the economics. Further, when the present invention is applied to high tension steel sheets (so-called BH steel sheets), the baking temperatures of below 150° C. are preferable.

The above mentioned resin composition film of the invention is formed on the chromate film in an amount deposited of 0.2 to 2.5 g/m$^2$, preferably 0.5 to 2.0 g/m$^2$. If the amount deposited of the resin film is smaller than 0.2 g/m$^2$, no sufficient corrosion resistance can be obtained, and if the amount deposited of the resin film is larger than 2.5 g/m$^2$, the weldability (especially, the adaptability to continuous multi-spot welding) is reduced. Accordingly, a deposited amount in the range of 0.2 to 2.5 g/m$^2$ is preferred for a highly corrosion-resistant surface-treated steel body for a car body.

Cation electrodeposition is effected on a car body. If the wet electric resistance of the chromate film plus the resin composition film exceeds 200 kΩ/cm$^2$, a cation electro-deposition coating is not formed in a good condition. Accordingly, in the steel sheet of the invention, which is used mainly for a car body, it is preferred that the chromate film and resin composition film be formed so that the wet electric resistance of the chromate film plus the resin composition film is controlled below 200 kΩ/cm$^2$.

The present invention includes a steel plate having the above mentioned film structure on one or both of the surfaces. For example, the steel plate of the invention includes the following embodiments.

| | | |
|---|---|---|
| (1) | One surface | deposited film - chromate film - resin composition film |
| | Other surface | Fe surface |
| (2) | One surface | deposited film - chromate film - resin composition film |
| | Other surface | deposited film |
| (3) | Both surfaces | deposited film - chromate film - resin composition film |

Highly corrosion resistant surface treated steel plates produced by the present invention are not only used for automotive bodies but home electrical appliances or buildings.

Depending upon the present invention, by lowering the ratio of $Cr^{6+}/Cr^{3+}$in the chromate solution without gelatinizing the solution, and containing substances useful to the Cr elusion in the chromate solution, the Cr elusion may be largely improved in comparison with the prior art, and the repairing effect of $Cr^{6+}$is maintained for a long period of time. Thus, the film having the excellent corrosion resistance may be obtained.

The chromate film does not require the drying at the high temperature but exhibits the excellent Cr elusion and the corrosion resistance in spite of the drying at the low temperature. The present invention is an economically useful method.

EXAMPLES

Various kinds of plated steel sheets for inner sides of the automobile bodies were alkali-degreased, water-washed, dried and coated, by means of the roll coater, with the chromate solution in which the concentrations of the chromate, phosphate ion, zirconium fluoride ion and Zn ion, and weight ratios of $Cr^{6+}/Cr^{3+}$ and chromic acid/zirconium fluoride ion were variously varied, and dried. Subsequently, the resin compositions were coated by means of the roll coater, and baked. The thus obtained steel sheets were tested with respect to the corrosion resistance, the paint adhesion and Cr elusion. Results are shown in Table 1-a to 1-f.

In one of the comparative examples, the chromate treatment was the electrolytic chromate treatment where $CrO_3$ was 50 g/l, $H_2SO_4$ was 0.5 g/l, the bath temperature was 50° C., the current density was 4.9 A/dm$^2$, and the electrolytic times were set in response to objective amounts of Cr adhesions.

The base resins were prepared by the under methods. (I) A reaction vessel equipped with a reflex cooler, a stirrer, a thermometer and a nitrogen-blowing device was charged with 1600 g of Epikote 1004 (epoxy resin supplied by Shell Chemical, molecular weight=about 1600), 57 g of pelargonic acid and 80 g of xylene, and reaction was carried out at 170° C. until the acid value of the reaction product was reduced to 0. Xylene was removed under reduced pressure to obtain a reaction intermediate (A).

(II) A reaction vessel equipped with a stirrer, a reflux cooler, a thermometer and a liquid dropping funnel was charged with 1880 g (0.5 mole) of Epikote 1009 (epoxy resin supplied by Shell Chemical, molecular weight=3750) and 1000 g of a methylisobutylketone/xylene mixed solvent=1/1 (weight ratio) and the content was heated with stirring and the resin was homogeneously dissolved at the boiling point of the solvent. Then, the solution was cooled to 70° C. and 70 g of di(n-propanol)-amine contained in the liquid dropping funnel was dropped to the solution in the reaction vessel over a period of 30 minutes. During this period, the reaction temperature was maintained at 70° C. After the dropwise addition, the reaction mixture was maintained at 120° C. hours to complete the reaction and obtain a resin A. The content of the effective component in the resin A was 66%.

(III) The same reaction vessel as used in (II) above was charged with 1650 g of the reaction intermediate (A) obtained in (I) above and 1000 g of xylene, and the content was heated ar 100° C. and 65 g of diethanolamine and 30 g of monoethanolamine contained in the liquid dropping funnel were dropped into the reaction vessel over a period of 30 minutes. Then, the reaction mixture was maintained at 120° C. for 2 hours to complete the reaction and obtain a resin B. The content of the effective component in the resin B was 63%.

The curing agents were prepared by the under mentioned methods.

(I) A reaction vessel equipped with a thermometer, a stirrer and a reflux cooler was charged with 250 parts of 4,4-diphenylmethane diisocyanate and 50 parts of diisobutylketone, and they were homogeneously mixed together. Then, 184 parts of ethylene glycol monoethyl ether was added to the mixture, and reaction was carried out for 2 hours at 90° C. and for 3 hours at 110° C. to obtain a completely urethanated curing agent a. The content of the effective component in the curing agent a was 89%.

(II) A reaction vessel equipped with a thermometer, a stirrer and a reflux cooler provided with a dropping funnel was charged with 222 parts of isophorone diisocyanate, and 100 parts of methylisobutylketone was added to form a homogeneous solution. Then, 88 parts of a 50% solution of trimethylolpropane in methylisobutylketone ketone was dropped from the dropping funnel to the isocyanate solution being stirred at 70° C. over a period of 1 hour. Then, the reaction mixture was maintained at 70° C. for 1 hour and at 90° C. for 1 hour. Then 230 parts of n-butyl alcohol was added and reaction was carried out at 90° C. for 3 hours to obtain a blocked isocyanate designated as curing agent b. The content of the effective component in the curing agent b was 76%.

With respect to the tests of the corrosion resistance, the edges and rear surface of each of the test samples were sealed with the tape, and the complex corrosive tests were carried out up to 100 cycles where 1 cycle was 50° C. 5% Brine Spray 5 hours
↓
60° C. Drying 2 hours
↓
50° C. 95% RH Wetting 2 hours.

The test samples were valued with red rust appearing areas. The lower half parts of the sample was cross-cut by a cutter for testing.

In the paint adhesion tests, each of the samples was subjected to the phosphate treatment with PB-L3020 of Nippon Parker Rising, and electrodeposited of 20 μ thickness with Cation Electrodeposition Power Top U-100 of Nippon Paint Ltd., and further sprayed of 30 μ with Luga Bake B531 White of Kansai Paint Co., Ltd. The tests were made on the primary adhesion and the secondary adhesion.

At the primary adhesion test, 100 square cuts were formed at intervals of 1 mm on the coating surface of the sample, and an adhesive tape was applied to the cut surface and then peeled. At the secondary adhesion test, the coated sample was immersed in the warm water (pure water) at 40° C. for 120 hours, and within 30 minutes, cut squares were formed at intervals of 1 mm in the same manner as described above, and an adhesive tape was applied to the cut surface and was then peled.

With respect to Cr elusion test, with 1 l of a liquid degreasing agent FC-4410 of Nippon Parker Rising, 0.6 $m^2$ of each of the specimens were degreased under the standard conditions to determine the amount of Cr in that by atomic absorption.

TABLE 1

| | | | Chromate Solution | | | | | | | Resin Composition | | | | | | | Quality Properties | | | | |
|---|---|---|---|---|---|---|---|---|---|---|---|---|---|---|---|---|---|---|---|---|---|
| | | *1 | *2 | *3 | *4 | *5 | *6 | *7 | *8 | *9 | *10 | *11 | *12 | *13 | *14 | *15 | *16 | *17 Q | | *18 | |
| | No. | A | B | C | D | E | F | G | H | I | J | K | L | M | N | O | P | R | S | T | U |
| Examples of the Invention | 1 | B | 5 | 4 | 0.5 | 1 | 3/3 | 10/1 | 50 | 2 | 1 | 4 | 60/40 | 30/10 | 1.0 | 140 | ◎ | ◎ | ◎ | ◎ | |
| | 2 | " | 100 | 4 | 10 | 1 | " | " | " | " | " | " | " | " | " | " | ◎ | ◎ | ◎ | ◎ | |
| | 3 | " | 20 | 0.5 | 1 | 1 | " | 20/1 | " | " | " | " | " | " | " | " | ◎ | ◎ | ◎ | ◎ | |
| | 4 | " | " | 20 | 1 | 1 | " | " | " | " | " | " | " | " | " | " | ◎ | ◎ | ◎ | ◎ | |
| | 5 | " | 10 | 4 | 0.2 | 1 | " | 50/1 | " | " | " | " | " | " | " | " | ◎ | ◎ | ◎ | ◎ | |
| | 6 | " | 40 | 4 | 4 | 1 | " | 10/1 | " | " | " | " | " | " | " | " | ◎ | ◎ | ◎ | ◎ | |
| | 7 | " | 20 | 4 | 1 | 0.2 | " | 20/1 | " | " | " | " | " | " | " | " | ◎ | ◎ | ◎ | ◎ | |
| | 8 | " | " | 4 | 1 | 7 | " | " | " | " | " | " | " | " | " | " | ◎ | ◎ | ◎ | ◎ | |
| | 9 | " | " | 4 | 1 | 1 | 3/4 | " | " | " | " | " | " | " | " | " | ◎ | ◎ | ◎ | ◎ | |
| | 10 | " | " | 4 | 1 | 1 | 3/2 | " | " | " | " | " | " | " | " | " | ◎ | ◎ | ◎ | ◎ | |
| | 11 | " | 100 | 4 | 1 | 1 | 3/3 | 100/1 | " | " | " | " | " | " | " | " | ◎ | ◎ | ◎ | ◎ | |
| | 12 | " | 20 | 4 | 1 | 1 | " | 20/1 | " | 1 | " | " | " | " | " | " | ◎ | ○+ | ○+ | ◎ | |
| | 13 | " | " | 4 | 1 | 1 | " | " | " | 3 | " | " | " | " | " | " | ◎ | ◎ | ◎ | ◎ | |

TABLE 1-continued

| | | | | | | | | | | | | | | | | | | | | |
|---|---|---|---|---|---|---|---|---|---|---|---|---|---|---|---|---|---|---|---|---|
| | 14 | " | " | 4 | 1 | 1 | " | " | " | 4 | " | " | " | " | " | " | ◎ | ◎ | ◎ | ◎ | |
| | 15 | " | " | 4 | 1 | 1 | " | " | " | 5 | " | " | " | " | " | " | ◎ | ○+ | ○+ | ◎ | |
| | 16 | " | " | 4 | 1 | 1 | " | " | " | 7 | " | " | " | " | " | " | ○+ | ○+ | ○+ | ◎ | |
| | 17 | " | " | 4 | 1 | 1 | " | " | " | 8 | " | " | " | " | " | " | ◎ | ◎ | ◎ | ◎ | |
| | 18 | " | " | 4 | 1 | 1 | " | " | " | 9 | " | " | " | " | " | " | ◎ | ◎ | ◎ | ◎ | |
| | 19 | " | " | 4 | 1 | 1 | " | " | " | 2 | " | — | 50/50 | 40/0 | " | " | ○+ | ◎ | ◎ | ◎ | |
| | 20 | " | " | 4 | 1 | 1 | " | " | " | " | " | — | 60/40 | " | " | " | ○+ | ◎ | ◎ | ◎ | |
| | 21 | " | " | 4 | 1 | 1 | " | " | " | " | " | — | 80/20 | " | " | " | + | ◎ | ◎ | ◎ | |
| | 22 | " | " | 4 | 1 | 1 | " | " | " | " | — | 4 | 50/50 | 0/40 | " | " | ○ | ◎ | ◎ | ◎ | |
| | 23 | " | " | 4 | 1 | 1 | " | " | " | " | — | " | 60/40 | " | " | " | ○ | ◎ | ◎ | ◎ | |
| | 24 | " | " | 4 | 1 | 1 | " | " | " | " | — | " | 80/20 | " | " | " | ○ | ◎ | ◎ | ◎ | |
| | 25 | " | " | 4 | 1 | 1 | " | " | " | " | 1 | " | 50/50 | 30/10 | " | " | ◎ | ◎ | ◎ | ◎ | |
| | 26 | " | " | 4 | 1 | 1 | " | " | " | " | " | " | 80/20 | " | " | " | ◎ | ◎ | ◎ | ◎ | |
| | 27 | " | " | 4 | 1 | 1 | " | " | " | " | " | " | 60/40 | 20/20 | " | " | ◎ | ◎ | ◎ | ◎ | |
| | 28 | " | " | 4 | 1 | 1 | " | " | " | " | " | " | " | 37/3 | " | " | ◎ | ◎ | ◎ | ◎ | |
| | 29 | " | " | 4 | 1 | 1 | " | " | " | " | " | " | " | 30/10 | " | " | ◎ | ◎ | ◎ | ◎ | |
| | 30 | " | " | 4 | 1 | 1 | " | " | " | " | 3 | " | " | " | " | " | ○+ | ◎ | ◎ | ◎ | |
| | 31 | " | " | 4 | 1 | 1 | " | " | " | " | 4 | " | " | " | " | " | ○+ | ◎ | ◎ | ◎ | |
| | 32 | " | " | 4 | 1 | 1 | " | " | " | " | 5 | " | " | " | " | " | ○+ | ◎ | ◎ | ◎ | |
| | 33 | " | " | 4 | 1 | 1 | " | " | " | " | 1 | 1 | " | " | " | " | ◎ | ◎ | ◎ | ○ | |
| | 34 | " | " | 4 | 1 | 1 | " | " | " | " | " | 2 | " | " | " | " | ○ | ◎ | ◎ | Δ | |
| | 35 | " | " | 4 | 1 | 1 | " | " | " | " | " | 3 | " | " | " | " | ○ | ◎ | ◎ | Δ | |
| | 36 | " | " | 4 | 1 | 1 | " | " | " | " | " | 5 | " | " | " | " | ○ | ◎ | ◎ | ○ | |
| | 37 | " | " | 4 | 1 | 1 | " | " | " | " | " | 6 | " | " | " | " | ○ | ◎ | ◎ | Δ | |
| | 38 | " | " | 4 | 1 | 1 | " | " | " | " | " | 7 | " | " | " | " | ○ | ◎ | ◎ | Δ | |
| | 39 | " | " | 4 | 1 | 1 | " | " | " | " | " | 4 | " | " | 0.2 | " | ○ | ◎ | ◎ | ◎ | |
| | 40 | " | " | 4 | 1 | 1 | " | " | " | " | " | " | " | " | 0.5 | " | ◎ | ◎ | ◎ | ◎ | |
| | 41 | " | " | 4 | 1 | 1 | " | " | " | " | " | " | " | " | 2.0 | " | ◎ | ◎ | ◎ | ◎ | |
| | 42 | " | " | 4 | 1 | 1 | " | " | " | " | " | " | " | " | 2.5 | " | ◎ | ◎ | ◎ | ◎ | V |
| | 43 | " | " | 4 | 1 | 1 | " | " | " | " | " | " | " | " | 1.0 | 50 | ◎ | ◎ | ◎ | ○ | |
| | 44 | " | " | 4 | 1 | 1 | " | " | " | " | " | " | " | " | " | 60 | ◎ | ◎ | ◎ | ◎ | |
| | 45 | " | " | 4 | 1 | 1 | " | " | " | " | " | " | " | " | " | 150 | ◎ | ◎ | ◎ | ◎ | |
| | 46 | " | " | 4 | 1 | 1 | " | " | " | " | " | " | " | " | " | 200 | ○+ | ◎ | ◎ | ◎ | |
| | 47 | " | " | 4 | 1 | 1 | " | " | 10 | " | " | " | " | " | " | 140 | ○ | ◎ | ◎ | ◎ | |
| | 48 | " | " | 4 | 1 | 1 | " | " | 30 | " | " | " | " | " | " | " | ◎ | ◎ | ◎ | ◎ | |
| | 49 | " | " | 4 | 1 | 1 | " | " | 150 | " | " | " | " | " | " | " | ◎ | ◎ | ◎ | ◎ | |
| | 50 | " | " | 4 | 1 | 1 | " | " | 200 | " | " | " | " | " | " | " | ◎ | ◎ | ◎ | ○ | V |
| | 51 | A | " | 4 | 1 | 1 | " | " | 50 | " | 2 | " | " | " | " | 140 | ○+ | ◎ | ◎ | ◎ | |
| | 52 | C | " | 4 | 1 | 1 | " | " | " | " | " | " | " | " | " | " | ○ | ◎ | ◎ | ◎ | |
| | 53 | D | " | 4 | 1 | 1 | " | " | " | " | " | " | " | " | " | " | ○ | ◎ | ◎ | ◎ | |
| | 54 | E | " | 4 | 1 | 1 | " | " | " | " | " | " | " | " | " | " | ○ | ◎ | ◎ | ◎ | |
| | 55 | F | " | 4 | 1 | 1 | " | " | " | " | " | " | " | " | " | " | ○ | ◎ | ◎ | ◎ | |
| | 56 | G | " | 4 | 1 | 1 | " | " | " | " | " | " | " | " | " | " | ◎ | ◎ | ◎ | ◎ | |
| Examples of the Comparison | 57 | B | " | 4 | 1 | 1 | " | " | " | " | 1 | — | 90/10 | 40/0 | " | " | X | ◎ | ◎ | ◎ | |
| | 58 | " | " | 4 | 1 | 1 | " | " | " | " | " | — | 40/60 | " | " | " | X | X | X | X | |
| | 59 | " | " | 4 | 1 | 1 | " | " | " | " | — | 4 | 90/10 | 0/40 | " | " | X | ◎ | ◎ | ◎ | |
| | 60 | " | " | 4 | 1 | 1 | " | " | " | " | — | " | 40/60 | " | " | " | X | X | X | X | |
| | 61 | " | 3 | 4 | 0.2 | 1 | " | 15/1 | 5 | " | 1 | " | 60/40 | 30/10 | " | " | X | ◎ | ◎ | ◎ | |
| | 62 | " | 150 | 4 | 3 | 1 | " | 50/1 | 250 | " | " | " | " | " | " | " | ◎ | ◎ | ◎ | X | W |
| | 63 | " | 20 | 0.3 | 1 | 1 | " | 20/1 | — | — | — | — | — | — | — | — | — | — | — | — | X |
| | 64 | " | 20 | 30 | 1 | 1 | " | " | 50 | 2 | 1 | 4 | 60/40 | 30/10 | 1.0 | 140 | X | ◎ | ◎ | ◎ | |
| | 65 | " | 5 | 4 | 0.1 | 1 | " | 50/1 | " | " | " | " | " | " | " | " | X | ◎ | ◎ | ◎ | |
| | 66 | " | 50 | 4 | 5 | 1 | " | 10/1 | — | — | — | — | — | — | — | — | — | — | — | — | X |
| | 67 | " | 20 | 4 | 1 | 0.1 | " | 20/1 | 50 | 2 | 1 | 4 | 60/40 | 30/10 | 1.0 | 140 | ◎ | ◎ | ◎ | X | |
| | 68 | " | " | 4 | 1 | 8 | " | " | — | — | — | — | — | — | — | — | — | — | — | — | X |
| | 69 | " | " | 4 | 1 | 1 | 3/5 | " | — | — | — | — | — | — | — | — | — | — | — | — | X |
| | 70 | " | " | 4 | 1 | 1 | 3/1 | " | 50 | 2 | 1 | 4 | 60/40 | 30/10 | 1.0 | 140 | ◎ | ◎ | ◎ | X | |
| | 71 | " | " | 4 | 4 | 1 | 3/3 | 5/1 | " | " | " | " | " | " | " | " | X | ◎ | ◎ | ◎ | |
| | 72 | " | 40 | 4 | 0.2 | 1 | " | 200/1 | " | " | " | " | " | " | " | " | Δ | ◎ | ◎ | Δ | |
| | 73 | " | 20 | 4 | 1 | 1 | " | 20/1 | " | 6 | " | " | " | " | " | " | ◎ | X | X | ◎ | |
| | 74 | " | " | 4 | 1 | 1 | " | " | " | 10 | " | " | " | " | " | " | Δ | ○ | ○ | ○ | |
| | 75 | " | " | 4 | 1 | 1 | " | " | " | 11 | — | — | — | — | " | 250 | Δ | ◎ | ○ | ◎ | |
| | 76 | " | " | 4 | 1 | 1 | " | " | " | 2 | 1 | 4 | 90/10 | 30/10 | " | 140 | Δ | ◎ | ◎ | ◎ | |
| | 77 | " | " | 4 | 1 | 1 | " | " | " | " | " | " | 40/60 | " | " | " | Δ | X | X | X | |
| | 78 | " | " | 4 | 1 | 1 | " | " | " | " | " | " | 60/40 | " | 0.1 | " | X | ◎ | ◎ | X | |
| | 79 | " | " | 4 | 1 | 1 | " | " | " | " | " | " | " | " | 3.0 | " | ◎ | — | — | ◎ | Y |
| | 80 | " | " | 4 | 1 | 1 | " | " | " | " | " | " | " | " | 1.0 | 40 | ○ | ◎ | ◎ | X | |
| | 81 | " | " | 4 | 1 | 1 | " | " | " | " | " | " | " | " | " | 250 | ○ | ◎ | ◎ | ◎ | |
| | 82 | " | Chromate treatment of Japanese Pat. Laid-Open No. 62-202083 | | | | | | " | " | " | " | " | " | " | " | Δ | ◎ | ◎ | ◎ | |
| | 83 | " | Electrolytic chromate Treat. | | | | | | " | " | " | " | " | " | " | " | Δ | ◎ | ◎ | ◎ | |

Note
A: Plated steel sheets
B: Concentration of $CrO_3$ (g/l)
C: $PO_4^{3-}$ (g/l)
D: $ZrF_6^{2-}$ (g/l)
E: $Zn^{2+}$ (g/l)
F: $Cr^{6+}/Cr^{3+}$
G: $CrO_3ZrF_6^{2}$
H: Cr adhering amount ($mg/m^2$)
I: Base resins TABLE 1-continued J: Silica
K: Cr compound
L: Resin/Additive
M: $SiO_2$/Cr compound
N: Adhering amount ($g/m^2$)
O: Baking temperature (°C.)
P: Corrosion resistance
Q: Paint adhesion
R: Initial period
S: Warm water
T: Cr elusion
U: Remarks
V: Slightly inferior spot weldability
W: Inferior spot weldability
X: Chromate solution was gelatinized in a short time
Y: No electrodeposition could be done
Inferior spot weldability
*1: Refer to Table 2.
*2: Total Cr amount in the chromate bath was shown with the concentration calculated as $CrO_3$.
*3: Phosphate ion was controlled by adding orthophosphoric acid and shown with $PO_4^{3-}$.
*4: Zirconium fluoride ion was controlled by adding $H_2ZrF_6$ and shown with the concentration of $ZrF_6^{2-}$.
*5: Zn ion was controlled by adding ZnO and shown with the concentration of $Zn^{2+}$.
*6: Weight ratio of $Cr^{6+}$ and $Cr^{3+}$ in the chromate bath.
*7: Weight ratio of chromic acid and zirconium fluoride ion in the chromate bath was shown with $CrO_3/ZnF_6^{2-}$.
*8: The adhering amount of the chromate film was measured with FX and shown with calculation as metallic Cr.
*9: Refer to Table 3.
*10: Refer to Table 4.
*11: Refer to Table 5.
*12: Weight ratio of base resin of resin composition/(silica + sparingly water soluble Cr compound) was shown with solid ratio
*13: Weight ratio of silica/sparingly water soluble Cr compound was shown with solid ratio.
*14: Silica amount or Cr amount was measured with FX, and the adhering amount of the resin composition was obtained by calculations with the above measured values.
*15: The temperatures of the sheets were shown with those (PMT: °C.) of the samples when they reached.
*16: Appreciation references of the corrosion resistance are shown as under.
◎: No red rust found
○+: Less than 5% of red rust
○: 5% to less than 10% of red rust
○−: More than 10% to less than 20% of red rust
Δ: More than 20% to less than 50% of red rust
X: More than 50% of red rust
*17: Appreciation references of the initial and warm water adhesion tests are shown as under.
◎: Peeled area - 0%
○+: Peeled area - smaller than 5%
○: Peeled area - from 5% to 10%
○−: Peeled area - from more than 10% to less than 20%
Δ: Peeled area - from more than 20% to less than 50%
X: Peeled area - more than 50%
*18: Appreciation references of Cr elusion are shown as under
: Less than 2 ppm of Cr in the degreasing liquid
: More than 2 ppm to less than 6 ppm of Cr in the degreasing liquid
Δ: More than 6 ppm to less than 12 ppm of Cr in the degreasing liquid
X: More than 12 ppm of Cr in the degreasing liquid

TABLE 3

| No. | Base resin | Curing agent | Catalyst |
|---|---|---|---|
| 1 | A 100 parts | a 25 parts | Bibutyl tin dilaurate 0.2 parts |
| 2 | A 100 parts | a 25 parts | Bibutyl tin dilaurate 1.0 part |
| 3 | A 100 parts | a 25 parts | — |
| 4 | A 100 parts | a 50 parts | Bibutyl tin dilaurate 2.0 parts |
| 5 | A 100 parts | a 80 parts | Bibutyl tin dilaurate 3.2 parts |
| 6 | A 100 parts | a 100 parts | Bibutyl tin dilaurate 4.0 parts |
| 7 | A 100 parts | — | — |
| 8 | A 100 parts | b 10 parts | Bismuth nitrate 1.0 part |
| 9 | B 100 parts | b 20 parts | N-ethyl morpholin 2.0 parts |
| 10 | Product obtained by adding 30 g/l of acetic acid to base resin A obtained by (II) at page 21 to render it water soluble. | | |
| 11 | Organic composite silicate (silica sol content = 40%, acrylic silicate/epoxy silicate ratio = 30/70) prepared according to Japanese Patent Application Laid-Oper. Specification No. 174879/85 | | |

TABLE 4

| | |
|---|---|
| 1 | Hydrophobic ultra-fine particulate silica (supplied by Nihon Aerozil Sha R 811) |
| 2 | Hydrophobic ultra-fine particulate silica (supplied by Nihon Aerozil Sha R 805) |
| 3 | Collidal-silica dispersed in organic solvent (OSCAL 1432 supplied by Shokubai Kasei Kogyo Sha) |
| 4 | Collidal silica dispersed in organic solvent (OSCAL 1622 supplied by Shokubai Kasei Kogyo Sha) |
| 5 | Hydrophilic silica (fumed silica) 200 supplied by Nippon Aerozie Co., Ltd. |

TABLE 2

| Plated sheets | | |
|---|---|---|
| A | Galvanization | (40 $g/m^2$) |
| B | Electric Zinc-alloy plating | (12% Ni-Zn, 20 $g/m^2$) |
| C | Electric Zinc-alloy plating | (25% Fe-Zn, 40 $g/m^2$) |
| D | Hot-dip Zn plating | (90 $g/m^2$) |
| E | Hot-dip Zn-alloy P. | (10% Fe-Zn, 45 $g/m^2$) |
| F | Hot-dip Zn-alloy P. | (5.0% Al-0.5% Mo, 90 $g/m^2$) |
| G | Electric Zinc-alloy plating | (60% Mn-Zn, 20 $g/m^2$) |

TABLE 5

| No. | Cr compounds | |
|---|---|---|
| 1 | $SrCrO_4$ | (Kikuchi Shikiso Kogyo) |
| 2 | $PbCrO$ | (Kikuchi Shikiso Kogyo) |
| 3 | $ZnCrO_4 \cdot 4Zn(OH)_2$ | (Kikuchi Shikiso Kogyo) |
| 4 | $BaCrO_4$ | (Kikuchi Shikiso Kogyo) |
| 5 | $CaCrO_4$ | (Kikuchi Shikiso Kogyo) |
| 6 | $K_20.4ZnO.4CrO_3.H_2O$ | (Kikuchi Shikiso Kogyo) |
| 7 | $K_2CrO_4$ | (Nihon Kagaku Kogyo) |

What is claimed is:

1. A method of producing highly corrosion-resistant surface-treated steel plates, comprising carrying out a chromate treatment of coating on the surface of a zinc or zinc alloy plated steel plate in a chromate solution comprising chromic acid: 5 to 100 g/l
phosphate ion: 0.5 to 20 g/l
zirconium fluoride ion: 0.2 to 4 g/l
Zr ion: 0.2 to 7 g/l, and
controlled in weight ratio in a bath of
$Cr^{6+}/Cr^{3+}=3/4$ to 3/2, and
chromic acid/zirconium fluoride ion
=10/1 to 100/1;

coating on an upper part of chromate film, without water-washing, an organic solvent type resin composition comprising a base resin obtained by adding at least one basic nitrogen atom and at least two primary hydroxyl groups to terminals of an epoxy resin which is mixed with silica in weight ratio of base resin/silica=80/20 to 50/50; and subsequently carrying out a baking treatment.

2. A method as claimed in claim 1, wherein a baking temperature is 50 to 200° C. in the steel plate.

3. A method as claimed in claim 1, wherein a chromate treated film is formed by continuing chromate treatment until the adhering amount of coating is 10 to 200 $mg/m^2$ calculated as metallic chromium.

4. A method as claimed in claim 1, wherein the resin composition contains an isocyanate compound as a curing agent at 5 to 80 parts per 100 parts of a base resin (as the solid).

5. A method as claimed in claim 1, wherein the silica for composing the solvent type resin composition is a hydrophobic silica.

6. A method as claimed in claim 1, wherein the film of the resin composition is formed in an adhering amount of 0.2 to 2.5 $g/m^2$.

7. A method of producing highly corrosion-resistant surface-treated steel plates, comprising carrying out a chromate treatment of coating on the surface of a zinc or zinc alloy plated steel plate in a chromate solution comprising chromic acid: 5 to 100 g/l
phosphate ion: 0.5 to 20 g/l
zirconium fluoride ion: 0.2 to 4 g/l
Zr ion: 0.2 to 7 g/l, and
controlled in weight ratio in a bath of
$Cr^{6+}/^{3+}=3/4$ to 3/2, and
chromic acid/zirconium fluoride ion
=10/1 to 100/1, thereby to form a chromate treated film in an adhering amount of 10 to 200 $mg/m^2$ calculated as metallic chromium; coating on an upper part of chromate film, without water-washing, an organic solvent type resin composition comprising a base resin obtained by adding at least one basic nitrogen atom and at least two primary hydroxyl groups to terminals of an epoxy resin which is mixed with hydrophobic silica in weight ratio of base resin/hydrophobic silica =80/20 to 50/50, and mixed with an isocyanate compound as a curing agent in an amount of 5 to 80 parts per 100 parts of the base resin (as the solid); and subsequently carrying out a baking treatment at a temperature of 50 to 200° C. in the steel plate, thereby to form a film of the resin composition in an adhering amount of 0.5 to 2.5 $g/m^2$on the chromate treated film.

8. A method of producing highly corrosion-resistant surface-treated steel plates, comprising carrying out a chromate treatment of coating on the surface of a zinc or zinc alloy plated steel plate in a chromate solution comprising chromic acid: 5 to 100 g/l
phosphate ion: 0.5 to 20 g/l
zirconium fluoride ion: 0.2 to 4 g/l
Zr ion: 0.2 to 7 g/l, and
controlled in weight ratio in a bath of
$Cr^{6+}/Cr^{3+}=3/4$ to 3/2, and
chromic acid/zirconium fluoride ion
=10/1 to 100/1;

coating on an upper part of chromate film, without water-washing, an organic solvent type resin composition comprising base resin obtained by adding at least one basic nitrogen atom and at least two primary hydroxyl groups to terminals of an epoxy resin which is mixed with sparingly water soluble Cr compound in weight ratio of base resin/sparingly water soluble Cr compound=80/20 to 50/50; and subsequently carrying out a baking treatment.

9. A method as claimed in claim 8, wherein a baking temperature is 50 to 200° C. in the steel plate.

10. A method as claimed in claim 8, wherein a chromate treated film is formed by continuing chromate treatment until the adhering amount of coating is 10 to 200 $mg/m^2$ calculated as metallic chromium.

11. A method as claimed in claim 8, wherein the resin composition contains an isocyanate compound as a curing agent at 5 to 80 parts per 100 parts of a base resin (as the solid).

12. A method as claimed in claim 8, wherein the sparingly water soluble Cr compound includes at least one member of the group consisting of $BaCrO_4$ and $SrCrO_4$.

13. A method as claimed in claim 8, wherein the film of the resin composition is formed in an adhering amount of 0.2 to 2.5 $g/m^2$.

14. A method of producing highly corrosion-resistant surface-treated steel plates, comprising carrying out a chromate treatment of coating on the surface of a zinc or zinc alloy plated steel plate in a chromate solution comprising chromic acid: 5 to 100 g/l
phosphate ion: 0.5 to 20 g/l
zirconium fluoride ion: 0.2 to 4 g/l Zr ion: 0.2 to 7 g/l, and
controlled in weight ratio in a bath of
$Cr^{6+}/Cr^{3+}=3/4$ to 3/2, and
chromic acid/zirconium fluoride ion
=10/1 to 100/1, thereby to form a chromate treated film in an adhering amount of 10 to 200 $mg/m^2$ calculated as metallic chromium; coating on an upper part of chromate film, without water-washing, an organic solvent type resin composition comprising a base resin obtained by adding at least one basic nitrogen atom and at least two primary hydroxyl groups to terminals of an epoxy resin which is mixed with at least one member of the group consisting of $BaCrO_4$ and $SrCrO_4$ as sparingly water soluble Cr compound in weight ratio of base resin/sparingly water soluble Cr compound=80/20 to 50/50, and mixed with isocyanate compound as the curing agent in an amount of 5 to 80 parts per 100 parts of the base resin (as the solid); and subsequently carrying out a baking treatment at a temperature of 50 to 200° C. in the steel plate, thereby to form a film of the resin composition in an adhering amount of 0.5 to 2.5 g/m$^2$ on the chromate treated film.

15. A method of producing highly corrosion-resistant surface-treated steel plates, comprising carrying out a chromate treatment of coating on the surface of a zinc or zinc alloy plated steel plate in a chromate solution comprising chromic acid: 5 to 100 g/l
phosphate ion: 0.5 to 20 g/l
zirconium fluoride ion: 0.2 to 4 g/l
Zr ion: 0.2 to 7 g/l, and
controlled in weight ratio in a bath of
$Cr^{6+}/Cr^{3+}$=¾ to 3/2, and
chromic acid/zirconium fluoride ion=
10/1 to 100/1;

coating on an upper part of chromate film, without water-washing, an organic solvent type resin composition comprising a base resin obtained by adding at least one basic nitrogen atom and at least two primary hydroxyl groups to terminals of an epoxy resin which is mixed with silica in weight ratio of base resin/(silica+sparingly water soluble Cr compound)
=80/20 to 50/50, and
silica/sparingly water soluble Cr compound=37/3 to 20/20, and subsequently carrying out a baking treatment.

16. A method as claimed in claim 15 wherein a baking temperature is 50° to 200° C. in the steel plate.

17. A method as claimed in claim 15 wherein a chromate treated film is formed by continuing chromate treatment until the adhering amount of coating is 10 to 200 mg/m$^2$ calculated as metallic chromium.

18. A method as claimed in claim 15 wherein the resin composition contains an isocyanate compound as a curing agent at 5 to 80 parts per 100 parts of a base resin (as the solid).

19. A method as claimed in claim 15 wherein the silica for composing the solvent type resin composition is a hydrophobic silica.

20. A method as claimed in claim 15 wherein the sparingly water soluble Cr compound contains at least one member of the group consisting of $BaCrO_4$ and $SrCrO_4$.

21. A method as claimed in claim 15 wherein the film of the resin composition is formed in the adhering amount of 0.2 to 2.5 g/m$^2$.

22. A method of producing highly corrosion-resistant surface-treated steel plates, comprising carrying out a chromate treatment of coating on the surface of a zinc or zinc alloy plated steel plate in a chromate solution comprising chromic acid: 5 to 100 g/l
phosphate ion: 0.5 to 20 g/l
zirconium fluoride ion: 0.2 to 4 g/l
Zr ion: 0.2 to 7 g/l, and
controlled in weight ratio in a bath of
$Cr^{6+}/Cr^{3+}$=3/4 to 3/2, and
chromic acid/zirconium fluoride ion
=10/1 to 100/1, thereby to form a chromate treated film in an adhering amount of 10 to 200 mg/m$^2$ calculated as metallic chromium; coating on an upper part of chromate film, without water-washing, an organic solvent type resin composition comprising a base resin obtained by adding at least one basic nitrogen atom and at least two primary hydroxyl groups to terminals of an epoxy resin which is mixed with hydrophobic silica and at least one member of the group consisting of $BaCrO_4$ and $SrCrO_4$ as sparingly water soluble Cr compound in weight ratio of base resin/(hydrophobic silica+ sparingly water soluble Cr compound)=80/20 to 50/50, and hydrophobic silica/sparingly water soluble Cr compound=37/3 to 20/20, and mixed with isocyanate compound as the curing agent in an amount of 5 to 80 parts per 100 parts of the base resin (as the solid), and subsequently carrying out a baking treatment at a temperature of 50 to 200° C. in the steel plate, thereby to form a film of the resin composition in an adhering amount of 0.5 to 2.5 g/m$^2$ on the chromate treated film.

23. A method as claimed in claim 2, wherein a baking temperature is 60 to 150° C. in the steel plate.

24. A method as claimed in claim 4, wherein the resin composition contains an isocyanate compound as a curing agent at 10 to 50 parts per 100 parts of a base resin (as the solid).

25. A method as claimed in claim 6, wherein the film of the resin composition is formed in an adhering amount of 0.5 to 2.0 g/m$^2$.

26. A method as claimed in claim 7, wherein the chromate treated film is formed in an adhering amount of 30 to 150 mg/m$^2$ calculated as metallic chromium; wherein said base resin is mixed with isocyanate compound as the curing agent in an amount of 10 to 50 parts per 100 parts of the base resin (as the solid); and wherein said baking treatment is carried out at a temperature of 60 to 150° C. in the steel plate, thereby to form a film of the resin composition in an adhering amount of 0.5 to 2.0 g/m$^2$ on the chromate treated film.

27. A method as claimed in claim 9, wherein a baking temperature is 60 to 150° C. in the steel plate.

28. A method as claimed in claim 10, wherein a chromate treated film is formed by continuing chromate treatment until the adhering amount of coating is 30 to 150 mg/m$^2$ calculated as metallic chromium.

29. A method as claimed in claim 11, wherein the resin composition contains an isocyanate compound as a curing agent at 10 to 50 parts per 100 parts of a base resin (as the solid).

30. A method as claimed in claim 13, wherein the film of the resin composition is formed in an adhering amount of 0.5 to 2.0 g/m$^2$.

31. A method as claimed in claim 14, wherein the chromate treated film is formed in an adhering amount of 30 to 150 mg/m$^2$ calculated as metallic chromium; wherein said base resin is mixed with isocyanate compound as the curing agent in an amount of 10 to 50 parts per 100 parts of the base resin (as the solid); and wherein said baking treatment is carried out at a temperature of 60 to 150° C. in the steel plate, thereby to form a film of the resin composition in an adhering amount of 0.5 to 2.0 g/m$^2$ on the chromate treated film.

32. A method as claimed in claim 16, wherein a baking temperature is 60 to 150° C. in the steel plate.

33. A method as claimed in claim 17, wherein a chromate treated film is formed by continuing chromate treatment until the adhering amount of coating is 30 to 150 mg/m$^2$ calculated as metallic chromium.

34. A method as claimed in claim 18, wherein the resin composition contains an isocyanate compound as a curing agent at 10 to 50 parts per 100 parts of a base resin (as the solid).

35. A method as claimed in claim 21, wherein the film of the resin composition is formed in the adhering amount of 0.5 to 2.0 g/m$^2$.

36. A method as claimed in claim 22, wherein the chromate treated film is formed in an adhering amount of 30 to 150 mg/m$^2$ calculated as metallic chromium; wherein said base resin is and mixed with isocyanate compound as the curing agent in an amount of 10 to 50 parts per 100 parts of the base resin (as the solid), and wherein said baking treatment is carried out at a temperature of 60 to 150° C. in the steel plate, thereby to form a film of the resin composition in an adhering amount of 0.5 to 2.0 g/m$^2$ on the chromate treated film.

* * * * *